US008447522B2

(12) United States Patent
Brooks

(10) Patent No.: US 8,447,522 B2
(45) Date of Patent: May 21, 2013

(54) METHOD FOR ESTIMATING THE PROBABILITY OF COLLISION BETWEEN WELLS

(75) Inventor: Andrew G. Brooks, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 352 days.

(21) Appl. No.: 12/493,397

(22) Filed: Jun. 29, 2009

(65) Prior Publication Data

US 2010/0169018 A1 Jul. 1, 2010

Related U.S. Application Data

(60) Provisional application No. 61/078,088, filed on Jul. 3, 2008.

(51) Int. Cl.

| | |
|---|---|
| ***G01V 1/40*** | (2006.01) |
| ***G01V 3/18*** | (2006.01) |
| ***G01V 5/04*** | (2006.01) |
| ***G01V 9/00*** | (2006.01) |
| ***E21B 44/00*** | (2006.01) |

(52) U.S. Cl.
USPC ..... 702/9; 702/6; 73/152.43; 73/152.46; 166/250.01; 166/255.2

(58) Field of Classification Search
USPC ..... 702/6, 9; 166/250.01, 255.2; 73/152.43, 73/152.46; 175/45
See application file for complete search history.

(56) References Cited

U.S. PATENT DOCUMENTS

| | | | | |
|---|---|---|---|---|
| 5,103,920 | A * | 4/1992 | Patton | 175/45 |
| 5,901,795 | A * | 5/1999 | Tsao et al. | 175/45 |
| 2007/0032984 | A1 | 2/2007 | Alfano | |

FOREIGN PATENT DOCUMENTS

| | | |
|---|---|---|
| WO | 9635859 | 11/1996 |

OTHER PUBLICATIONS

Alfano, S. "Relating Position Uncertainty to Maximum Conjunction Probability" paper AAS 03-548, presented at the AAS/AIAA Astrodynamics Specialists Conference, Big Sky, MT, Aug. 2003.

Alfano, S. "A Numerical Implementation of Spherical Object Collision Probability" Journal of the Astronautical Sciences, vol. 53, No. 1, Jan.-Mar. 2005.

Alfano, S. "Satellite Collision Probability Enhancements" Journal of Guidance, Control, and Dynamics, vol. 29, No. 3, May-Jun. 2006.

Alfano, S. "Addressing Nonlinear Relative Motion for Spacecraft Collision Probability" paper presented at theAIAA/AAS Astrodynamics Specialists Conference, Keystone, CO, Aug. 2006.

Alfano, S. "Review of Conjunction Probability Methods for Short-term Encounters" AAS paper 07-148, presented at the AAS/AIAA Space Flight Mechanics Meeting, Sedona, AZ, Jan.-Feb. 2007.

(Continued)

*Primary Examiner* — Janet Suglo

(74) *Attorney, Agent, or Firm* — Cantor Colburn LLP

(57) ABSTRACT

A method for drilling a well, the method including: identifying another well proximate to the well being drilled; collecting spatial information for at least a portion of the another well and the well being drilled; estimating a trajectory for at least a portion of the well being drilled and the another well; estimating an uncertainty in spatial information for each trajectory; estimating a probability of a collision with the another well during the drilling of the well by integrating a probability density function using the uncertainties and the trajectories; and performing the drilling in a manner that limits the probability of collision. A system and another method are provided.

19 Claims, 6 Drawing Sheets

OTHER PUBLICATIONS

Brooks, A.G. and Wilson, H. "An Improved Method for Computing Wellbore Position Uncertainty and its Application to Collision and Target Intersection Probability" SPE paper 36863, presented at Europec, Milan, Italy, Oct. 1996.
McKinley, D.P. "Development of a Nonlinear Probability of Collision Tool for the Earth Observing System" AIAA paper 2006-6295, presented at the AIAA/AAS Astrodynamics Specialist Conference, Keystone, CO, Aug. 2006.
Patera, R.P. "Satellite Collision Probability for Non-Linear Relative Motion" paper AIAA 2002-4632, presented at the AIAA/AAS Astrodynamics Specialist Conference and Exhibit, Monterey, CA, Aug. 2002.
Patera, R.P. "Method for Calculating Collision Probability between a Satellite and a Space Tether" Journal of Guidance, Control, and Dynamics, vol. 25, No. 5, Sep.-Oct. 2002.
Patera, R.P. "Collision Probability for Larger Bodies Having Nonlinear Relative Motion" Journal of Guidance, Control, and Dynamics, vol. 29, No. 6, Nov.-Dec. 2006.
Shoemake, K. "Animating Rotation with Quaternion Curves" Computer Graphics, vol. 19, No. 3, Jul. 1985.
Shoemake, K. and Duff, T. "Matrix Animation and Polar Decomposition" Graphics Interface, May 1992.
Thorogood, J.L., Hogg, T.W. and Williamson, H.S. "Application of Risk Analysis Methods to Subsurface Well Collisions" SPE paper 23941, SPE Drilling Engineering, vol. 6, No. 4, Dec. 1991, and SPE paper 23942 (supplement to SPE paper 23941).
Williamson, H.S. "Accuracy Prediction for Directional Measurement While Drilling" SPE paper 67616, SPE Drilling and Completion, vol. 15, No. 4, Dec. 2000.
J.Thorogood and S.Sawaryn (BP), "The Traveling Cylinder Diagram—A Practical Tool for Collision Avoidance" SPE paper 19989; describes a graphical tool McNair, G. et al.
Patera, R. P. "Space Vehicle Conflict Probability for Ellipsoidal Conflict Volumes". Journal of Guidance, Control, and Dynamics, vol. 30, No. 6, Nov.-Dec. 2007.

* cited by examiner

METHOD FOR ESTIMATING THE PROBABILITY OF COLLISION BETWEEN WELLS

CROSS REFERENCE TO RELATED APPLICATION

This application is a Non-Provisional of U.S. Provisional Ser. No. 61/078,088, filed Jul. 3, 2008, the contents of which are incorporated by reference herein in their entirety.

BACKGROUND OF THE INVENTION

1. Field of the Invention

The invention disclosed herein relates to oil field exploration and, in particular, to avoiding collisions between wells drilled during exploration.

2. Description of the Related Art

Unplanned collisions between oilwells can have catastrophic results. The industry therefore has an interest in developing risk assessment tools, including well-founded means for estimating the probability of such collisions.

Recent interest has focused on the development of improved models for describing survey accuracy and quality control of survey data to assure compliance with these models. The survey data along with the appropriate error models provide a basis for estimating the probability of collision.

In spite of pioneering attempts to express the complex problem in a simple form, most operators today still rely on rule-of-thumb methods with little mathematical foundation. For example, a clearance factor or separation factor is widely used as an indicator of collision probability. Such factors basically involve a ratio of well separation to positional uncertainty. There are many different implementations, none of which bears a strong mathematical correlation to collision probability. There is a better method with recent variations used for low-risk wells. This method and the variations thereof assume straight non-parallel wells, in which case the probability of collision depends only on the nominal separation and the positional uncertainties in the direction normal to the two wellpaths. Probability can be estimated by integration of a one-dimensional probability density function. When applied to points at the closest approach of two straight non-parallel wells, this method can give a meaningful estimate of the overall collision probability, under the assumption that the relative uncertainty does not change significantly over the intervals of interest. However, this method is unsuitable for evaluating collision risk over short intervals or between curved wellpaths or where the relative uncertainty cannot be assumed constant over the intervals of interest.

Methods which solve the problem by integration of two-dimensional (2D) or three-dimensional (3D) probability density functions are known. While sometimes less restrictive than the one-dimensional (1D) integration, these methods do not completely represent the general problem. A useful test of a method is whether it produces accurate results for both parallel and non-parallel wells, for straight or curved wellpaths, and for intervals of wells whose relative uncertainty may not be constant.

It must be recognized that a numerical estimate of collision probability is no better than the data from which it is derived. While a sound mathematical computation of probability is helpful, it also requires accurate knowledge of the magnitude and distribution of survey errors. Many, perhaps most, unplanned collisions result from human failures causing gross well positioning errors beyond the modeled error budget.

Therefore, what are needed are improved techniques for avoiding collision with an existing well while drilling another well. Preferably, the techniques make use of improved data and produce accurate results both for non-parallel wells and for parallel wells, which may be straight or curved with constant or varying relative spatial uncertainty.

BRIEF SUMMARY OF THE INVENTION

An embodiment of the invention includes a method for drilling a well, the method including: identifying another well proximate to the well being drilled; collecting spatial information for at least a portion of the another well and the well being drilled; estimating a trajectory for at least a portion of the well being drilled and the another well; estimating an uncertainty in spatial information for each trajectory; estimating a probability of a collision with the another well during the drilling of the well by integrating a probability density function using the uncertainties and the trajectories; and performing the drilling in a manner that limits the probability of collision.

Another embodiment of the invention includes a system for drilling a well, the system including: a drilling apparatus for drilling the well, the apparatus adapted for receiving directional information from a processor and adjusting drilling according to the directional information; the processor equipped for implementing instructions for avoiding collision during drilling of a well by performing a method including: identifying another well proximate to the well being drilled; collecting spatial information for at least a portion of the another well and the well being drilled; estimating a trajectory for at least a portion of the well being drilled and the another well; estimating an uncertainty in spatial information for each trajectory; estimating a probability of a collision with the another well during the drilling of the well by integrating a probability density function using the uncertainties and the trajectories; and performing the drilling in a manner that limits the probability of collision.

A further embodiment of the invention includes a method for estimating a probability of collision, P, between near-parallel wells, the method including: obtaining separation information, $S_0$, and radius information, $R_0$, for a given depth, L; and solving a relationship including:

$$P = \frac{1}{\pi}\cdot\sin^{-1}\left(\frac{R_0}{S_0}\right)\cdot\exp\left[-\frac{(S_0^2-R_0^2)}{2}\right] + \frac{1}{\pi}\cdot\int_{S_0-R_0}^{\sqrt{S_0^2-R_0^2}}\left[\cos^{-1}\left(\frac{S_0^2-R_0^2+x^2}{2\cdot S_0\cdot x}\right)\cdot x\cdot\exp\left(-\frac{x^2}{2}\right)\right]dx;$$

where: x represents a distance.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Disclosed are techniques for avoiding collision with an existing well (referred to as an "object well", or as "another well") during drilling of a new well (referred to as a "reference well" or a "well being drilled"). First, and as perspective, consider FIG. 1 which introduces aspects of a well.

Figure 1:
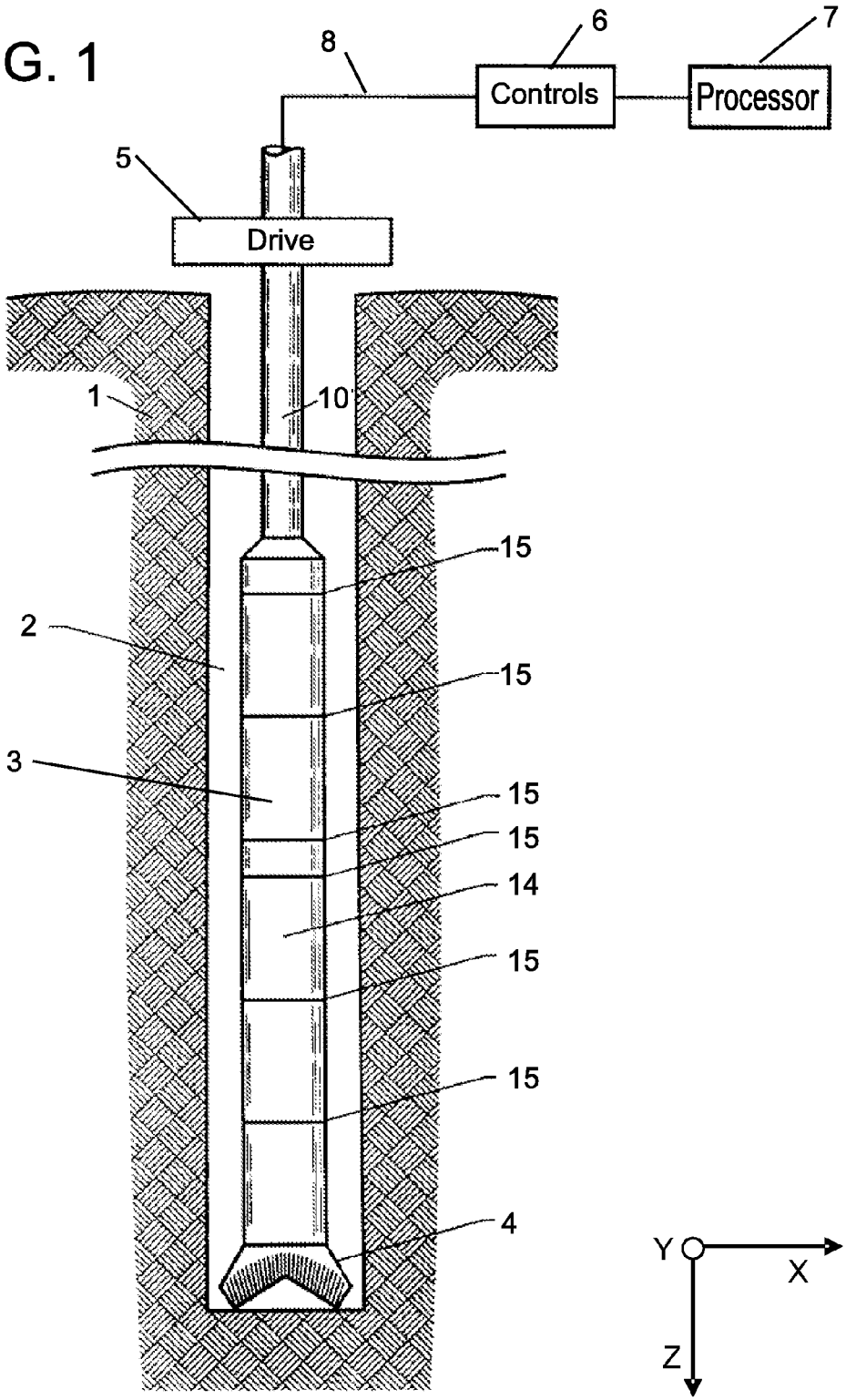
FIG. 1 depicts aspects of a system for drilling a wellbore.

Referring now to FIG. 1, there are shown aspects of an exemplary embodiment of a tool 3 for drilling a wellbore 2 (also referred to as a "borehole", and simply as a "well"). The tool 3 is included within a drill string 10 that includes a drill bit 4. The drill string 10 provides for drilling of the wellbore 2 into earth formations 1. The drill bit 4 is attached to a drill collar 14.

As a matter of convention herein and for purposes of illustration only, the tool 3 is shown as traveling along a Z-axis, while a cross section of the tool 3 is realized along an X-axis and a Y-axis. Accordingly, it is considered that each well may be described by spatial information in a coordinate system, such as the Cartesian coordinate system shown in FIG. 1.

The spatial information may include a variety of locational, positional and other type of coordinate information. For example, and without limitation, the spatial information may describe a trajectory of at least one of the wells, a diameter of a respective wellbore 2, a relationship between the object well and the reference well, and other such information.

A drive 5 is included and provides for rotating the drill string 10 and may include apparatus for providing depth control. Generally, control of the drive 5 and the tool 3 is achieved by operation of controls 6 and a processor 7 coupled to the drill string 10. The controls 6 and the processor 7 may provide for further capabilities. For example, the controls 6 may be used to power and operate sensors (such as an antenna) of the tool 3, while the processor 7 receives and at least one of packages, transmits and analyzes data provided by the tool 3.

The teachings provide for estimation of a probability that a particular interval of interest along the well 2 being drilled (referred to as the "reference interval" of a "reference well") might intersect a pre-existing well (referred to as the "object well").

The teachings provided also differ from existing methods in significant ways. For example, many existing methods apply to a point within a reference well rather than over a finite interval of the reference well (i.e., a reference interval). One skilled in the art will recognize that estimation of probability of collision over the reference interval is a more useful concept than collision at a point.

As presented herein, information used in the estimation may include survey data for the object well and the existing portion of the reference well, the planned drilling path (also referred to as a "wellpath") for the reference interval, and uncertainties associated with these data expressed in the form of survey error models or position error covariance matrices. The survey uncertainties can be used according to standard methods to estimate the relative uncertainty between a point in the reference well and another point along the object well. The relative uncertainties between such pairs of points may also be used to estimate the overall probability of collision. Generally, the uncertainty is expressed as a standard deviations, which for a given error distribution can be converted to a probability density function corresponding to a pair of points. The probability of collision may be found by integrating this probability density function over all points representing significant risk in the reference well and the object well.

Figure 2A:
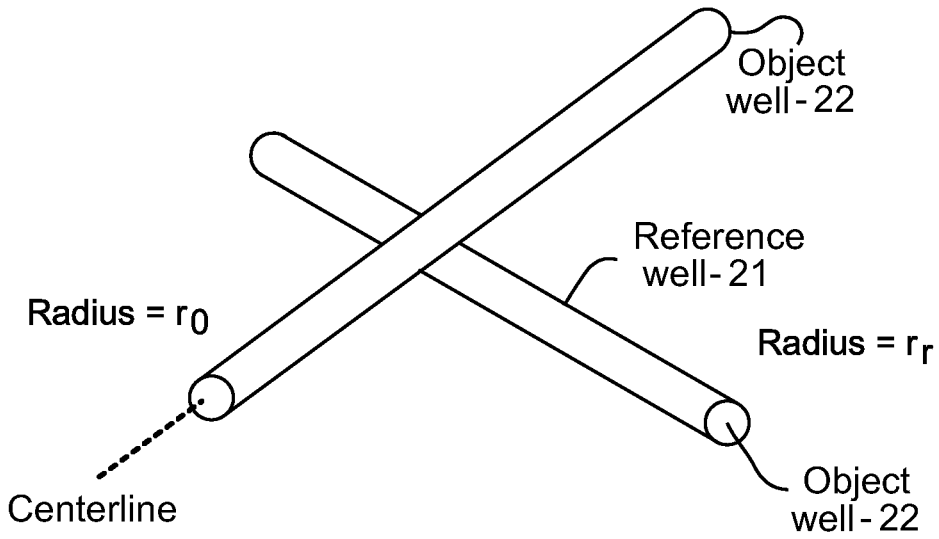
FIGS. 2A and 2B, collectively referred to herein as FIG. 2, depict equivalent representations of intersecting paths for wellbores.
Figure 2B:
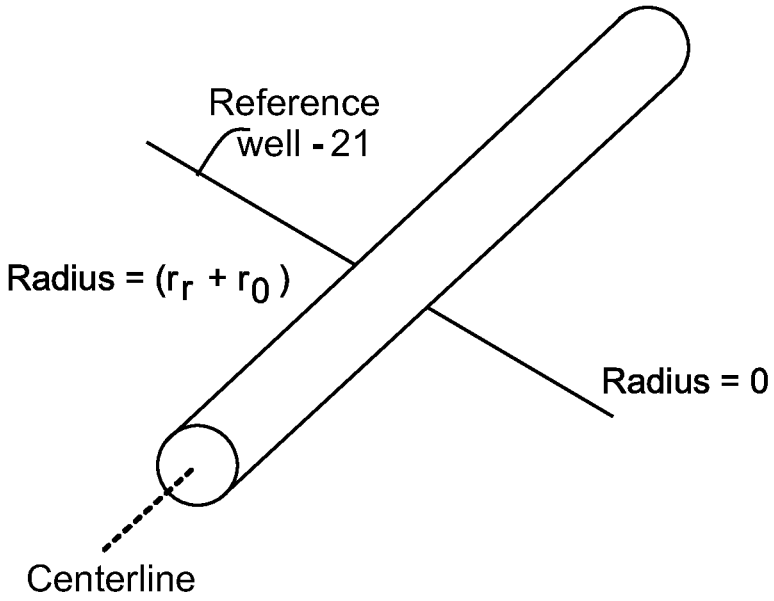

As a matter of convention, survey station positions are represented by points in space. Interpolation between these points gives the presumed trajectory of the centerline for each wellpath. The interpolation is generally completed according to the appropriate model (most commonly, a minimum curvature model). It is considered that if the centerline of the reference interval comes within a certain distance of the centerline of the object wellpath, a collision will occur. This critical separation distance is the sum of the radii of the two wells. Reference may be had to FIG. 2. In FIG. 2A, the reference well 21 (of radius $r_r$) and the object well 22 (of radius $r_o$) are depicted in a relationship. It may therefore be imagined that the object well 22 is a circular cylinder with radius equal to the sum of the radii of the two wells ($r_r$ and $r_o$, as shown in FIG. 2B). If the centerline of the reference interval should penetrate this cylinder then a collision will occur. The advantage of assigning both diameters ($r_r$ and $r_o$) to one well (in the case the object well 22 is that relative uncertainty may be used for estimations, and thus one need be concerned with only a single uncertainty field about a point of interest in the reference well 21.

Generally, it is not necessary to model an entire length of the object well 22. That is, it may be considered that the probability of collision is very small at well separation distances more than about six (6) standard deviations. For example, if a Gaussian error distribution is assumed, the probability of a three-dimensional (3D) positional error exceeding six (6) standard deviations is less than $10^{-7}$.

A position of the object well 22 relative to the start of the reference interval can be represented by a circular cylinder, with radius equal to the sum of the well radii ($r_r$ and $r_o$). As an observer progresses along the reference interval, the relative position of the object well changes in an opposite sense. Thus, as an observer moves east along the reference well 21, the relative position of the object well 22 appears to move west. The following question is then posed: "From which starting locations would the reference interval penetrate the object well?". These locations are found by projecting the cylinder representing the object well 22 along the reversed path of the reference interval.

Figure 3:
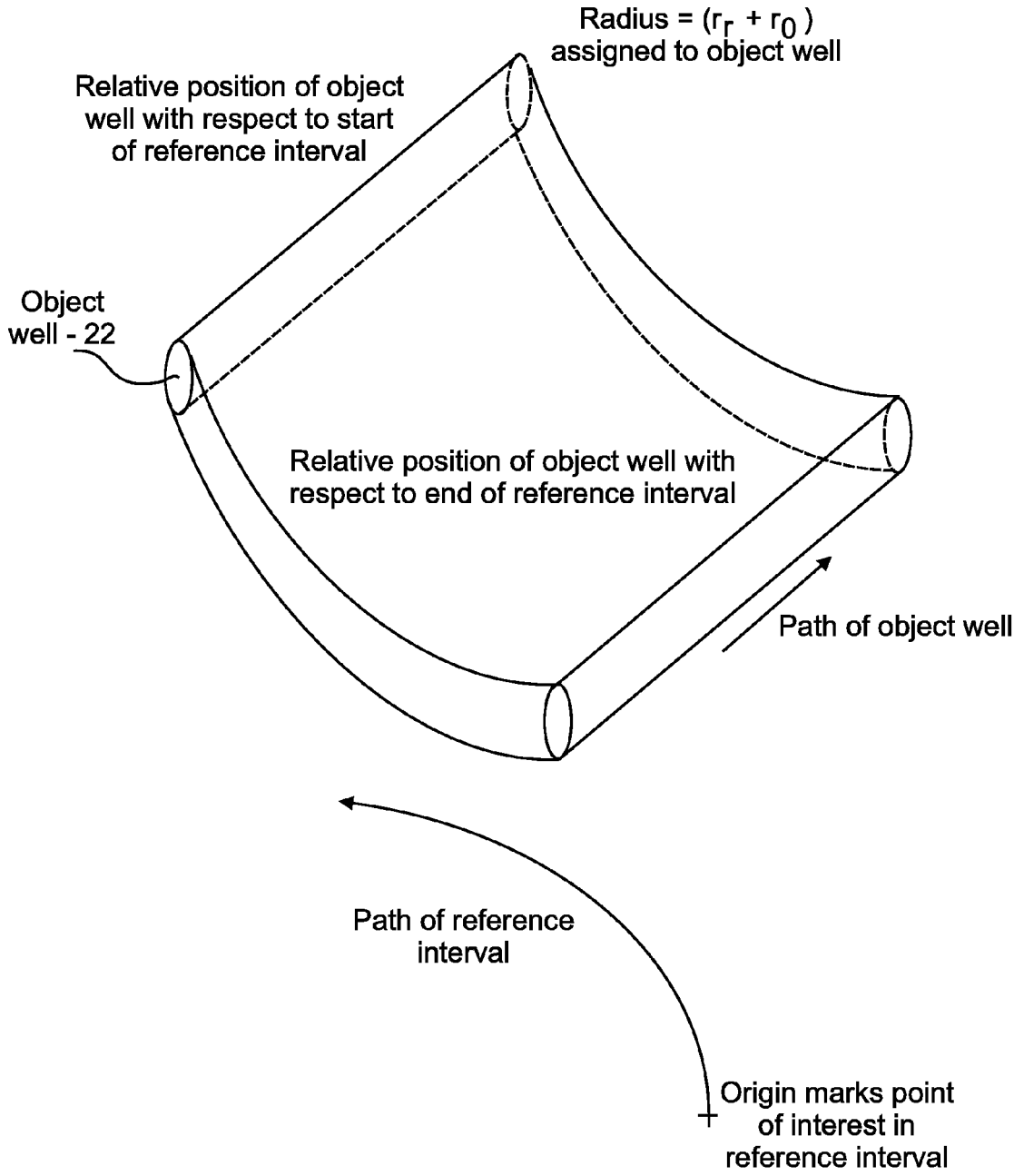
FIG. 3 depicts a volume swept by relative position of a region within a well of interest.

When applied to all points on the cylinder of the object well 22 and all points along the reference interval, this projection maps out a volume of interest. The volume may be illustrated as a three-dimensional (3D) sheet, of which two opposing faces are bounded by the shape of the cylinder of the object well 22, the other two faces are determined by the reversed shape of the reference interval, and the thickness is the sum of the well diameters ($2*r_r+2*r_o$). This volume is illustrated in FIG. 3. The face adjacent to a position of the object well 22 at the start of the reference interval is a concave circular cylinder, while the opposing face is a convex cylinder. If the start of the reference interval should happen to lie within this volume, a collision may be expected to occur within the reference interval.

Figure 4:
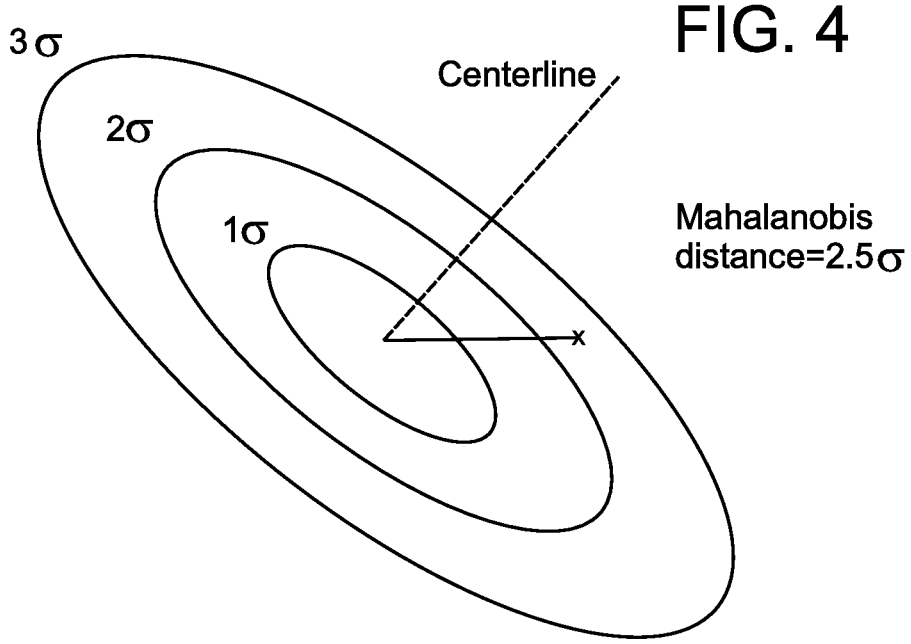
FIG. 4 depicts a distance scaled in standard deviations, referred to as a Mahalanobis distance.

In order to evaluate the probability of this event, the relative uncertainty between the object well 22 and the reference well 21 may be used to create a probability field about the reference point. The probability field may be thought of as a series of concentric ellipsoidal surfaces, each surface containing points which lie the same number of standard deviations from the origin, representing a contour of a three-dimensional probability density function. A probability contour is defined by Eq. (1):

$$r^T C^{-1} r = k^2 \quad (1)$$

where r represents a vector defining the position of the point of interest with respect to the origin in the reference interval, C represents the position covariance matrix defining relative uncertainty between the origin and the point of interest in the object well 22, and k represents a scale factor which represents the distance expressed as a number of standard deviations, also called the Mahalanobis distance. The Mahalanobis distance, k, is illustrated in FIG. 4. In order to enumerate the probability that a point lies within a given volume, it is necessary to define the error distribution. Common practice in the industry is to use a Gaussian distribution for this purpose, and such a distribution will be used in the examples presented here, but the method is applicable to other error distributions. The error distribution defines the probability density function, which relates probability density to Mahalanobis distance, k. The probability that the start of the reference interval lies within the volume of interest can then be found by integrating the three-dimensional probability density function over the volume. The integrating yields an approximation to the desired probability of collision.

Limitation of the basic solution. This procedure appears to provide a simple and complete solution to the general three-dimensional (3D) problem, albeit one which is not trivial to implement. However, the result of this integration is at best an approximation, because a constant uncertainty field was applied to the intervals along both wells. While this may be reasonable for intersections where a relative uncertainty can be assumed to be substantially constant, where the change in uncertainty is small over the interval of interest, this simplified approach is inaccurate where constant uncertainty may not be assumed. Further, it cannot be used at all when the two wells are believed to be parallel and side by side. In the case of parallel wells, the incremental risk of collision depends entirely on survey station uncertainty, which must produce a variation in the relative uncertainty. If there were no survey station uncertainty, the wells surveyed as parallel would indeed be parallel, and no collision could occur. The following discussion explains how this limitation can be removed or mitigated.

First, it is recognized that there are considerable similarities between analyses of oil well intersections and those of spacecraft orbital collisions. A distinction is made in astrodynamics between short-term or linear encounters in which the critical portions of satellite orbits are assumed straight and positional uncertainties are assumed constant, and long-term or non-linear encounters in which orbital curvature or variations in uncertainty must be considered. In general, non-linear problems are solved by integration of a three-dimensional (3D) probability density function, while linear problems can be reduced to two dimensions (2D). There are close analogies between short-term spacecraft encounters and intersections between straight wellpaths (where the wells are described with substantially constant relative uncertainty), also between long-term spacecraft encounters and well intersections with varying uncertainties or curved wellpaths.

At least one major difference between aerospace applications and oilfield applications is that the reference well 21 must avoid not only a point within the object well 22, but it must avoid the entire path of the object well 22. This means that the general oilwell problem will involve curved wellpaths and varying positional error covariance matrices in the encounter region; they must therefore be treated as non-linear problems whose solution requires three-dimensional (3D) integration. Certain special cases provide exceptions to this. Aspects of some of these cases are discussed herein.

Transformation to Mahalanobis space. The interval of interest in the object well 22 includes those points where risk of collision is considered significant. Normally this will include points within about six (6) standard deviations of the reference interval. The surveyed position of each point in the object well 22 is known with respect to the point of interest in the reference well 21 and its associated relative probability field. It is the position of the point with respect to the probability field that is important, not its position in space. When moving to a different point in either well, the relative uncertainty may be different and therefore the positions of the probability contours may change. If positions of the points in the object well 22 are normalized so that they are fixed with respect to the changing probability fields, it becomes possible to represent the object well 22 by a volume of uncertainty which is the envelope of a number of points, all points being plotted in the same probability field. This normalization of position is accomplished by reducing the ellipsoidal probability fields to spheres. The resulting plot looks similar to FIG. 3, but in a space which is scaled in standard deviations instead of in length units. Such a space is called a Mahalanobis space, in which the distance of any point from the origin is its Mahalanobis distance k, equal to the number of standard deviations from the origin.

Figure 5:
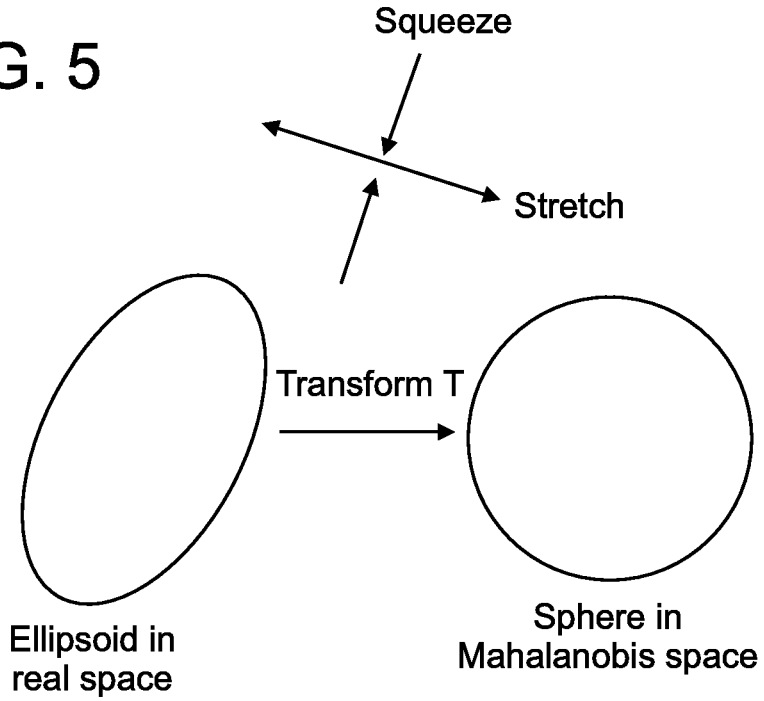
FIG. 5 depicts a transformation to a Mahalanobis space.

The transformation to Mahalanobis space is achieved by re-scaling to equalize the principal axes of the ellipsoid of uncertainty. Reference may be had to FIG. 5. This operation is aided by spectral decomposition of the covariance matrix C into a rotation matrix V and a scaling matrix E, where the columns of V are the eigenvectors of C, E is a diagonal matrix containing the eigenvalues of C, and provided as Eq. (2):

$$C = VEV^T \quad (2)$$

A point corresponding to the vector r in normal space is then represented by the point corresponding to T*r in Mahalanobis space, where the transformation matrix T is given by Eq. (3):

$$T = VE^{-1/2}V^T \quad (3)$$

Eq. (3) provides an affine transformation, under which straight lines are preserved but angles may change, and the circular tube representing the object well 22 may become elliptical in Mahalanobis space.

Interpolation. The relative covariance matrices are typically known only at points corresponding to survey stations, therefore it will be necessary to perform a matrix interpolation to transform intermediate points. The spectral decomposition of C into its components V and E assists this process. The rotation matrix V can be interpolated by spherical linear interpolation, known as "slerp", while elements of the diagonal matrix E can be interpolated linearly along the length parameter $E^{1/2}$. Alternatively, linear interpolation along elements of the variance matrix E can be used if it is thought that random errors dominate. As different parts of the object well are transformed according to different covariance matrices, a straight object well may not remain straight in Mahalanobis space.

Numerical Integration. A probability density corresponds to each point in the volume representing the object well. It is currently common practice to assume a Gaussian error distribution, although it is recognized that this may not be optimal.

Using numerical integration for integrating the probability density function over the volume corresponding to the object well yields a useful result. This is the probability that the point of interest, in this case the initial point of the reference interval, might coincide with the object well 22. However, if drilling to the start of the reference interval has been completed successfully, it is known that no such collision has yet occurred. Accordingly, incremental probability that a collision might occur over a specified interval to be drilled ahead in the reference well 21 is of a greater interest. Typically, while drilling, this reference interval is the distance to the next survey station. For example, a distance corresponding to either a joint of pipe or a stand. When a well is being planned, a longer interval might be used, sufficient to encompass all significant risks of collision. In this case, the reference interval might cover all points along the reference well 21 which approach within about six (6) standard deviations of surveyed positions for the object well 22.

Numerical integration should therefore be performed for a number of points along the reference interval. At each point, the interval of interest in the object well 22 is represented by a volume in Mahalanobis space. Additional volume elements now included in this volume which had not been included at prior steps along the reference interval indicate the potential for collisions incurred during the current step along the reference interval. The integral of the probability density function over these new volume elements represents the incremental probability that a collision might occur during the current step. The volume of interest is the added volume shown in FIG. 3, excluding the original position of the object well 22, plotted in Mahalanobis space.

The evaluation of the added volume is most conveniently done by dividing it into volume elements. After each step along the reference well 21, a number of new elements are added. The new elements may be approximated by, for example, hexahedra with one dimension equal to the step along the reference well 21, a second dimension representing step size along the object well 22, and the third dimension representing the sum of the well diameters ($2*r_r+2*r_o$). The volume elements can be made approximately orthogonal if the dimension representing the step along the reference interval is replaced by its projection normal to the object well 22. In most cases this will also permit the use of a longer step size along the reference interval while keeping the elements approximately equidimensional. The probability of collision can be computed as the sum of the new element volumes each multiplied by the probability density at their centroids. It is helpful to keep the elements approximately equidimensional. Thus a step size along the object well 22 may be chosen to be similar to the sum of the well diameters ($2*r_r+2*r_o$). It may sometimes be necessary to further subdivide the volume elements. For example, it may be helpful if dimensions of the elements are as small as 1/100 of a standard deviation in order to return an accurate result. Accuracy can also be improved by including the half-tube representing the object well 22 at the last step and removing the half-tube at the first step. The elliptical half-tubes can be approximated, for example, by polyhedral volume elements.

Examples. The method described above can be used to solve general problems of wellpath collision. It is also helpful in understanding simpler cases, several of which will be described here. Simple cases typically involve straight wellpaths and simple error models. Since the volume or points of interest only include a limited distance along each well (the reference interval in the reference well 21, and out to about six (6) standard deviations away in the object well 22), there will be cases where the covariance matrix describing relative uncertainty does not change significantly over these distances. Such cases normally occur when the distances of interest along the wells are short with respect to the measured depths. These will therefore be referred to as intersections where one can assume a substantially constant relative uncertainty, or, as a matter of convenience as "constant uncertainty." In examining constant uncertainty intersections, the covariance matrix is held constant and the probability density function can be integrated in real space over the volume of interest, without the need to transform the geometry into Mahalanobis space.

Figure 6:
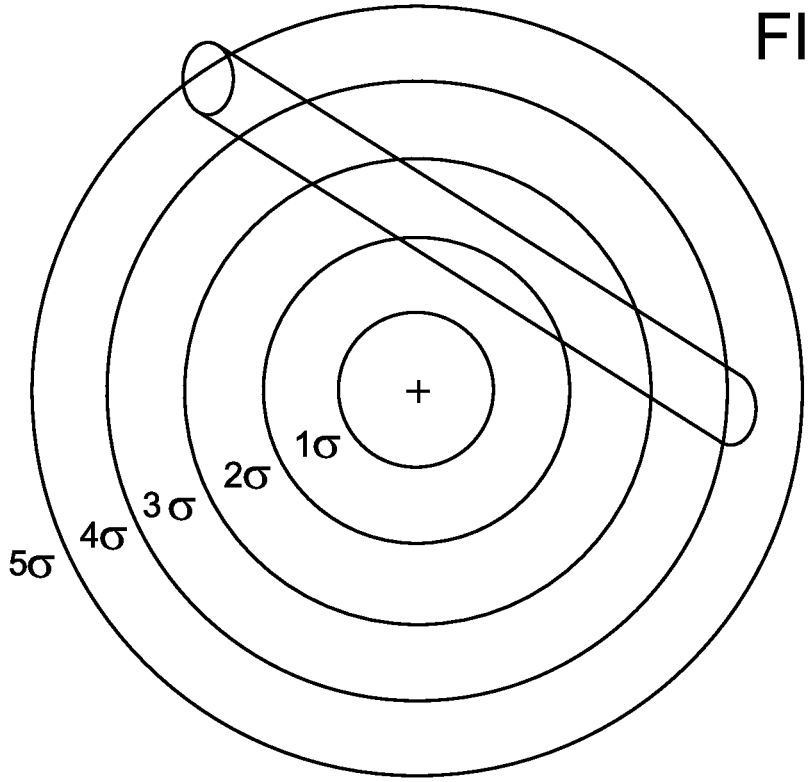
FIG. 6 depicts an interval of the well being drilled in a plane normal to an existing well.

Constant uncertainty, straight non-parallel wells. If the two wells are straight and non-parallel, the sheet over which integration is performed is a plane. If the object well 22 is straight over the interval of interest out to six (6) standard deviations, it may be considered to extend to infinity in either direction without significantly affecting the result. The integral along the axis of the object well 22 is unity, and the well radii may be assigned to the reference interval and projected into a plane normal to the object well 22, as shown in FIG. 6. In this plane, the area over which the 2D probability density is to be integrated is rectangular with rounded ends. That is, its length is equal to the reference interval and its width is equal to the sum of the well diameters. The probability of a collision occurring within this interval is the integral of a 2D probability density function over this area. If the reference interval is sufficiently long and straight, the problem can be further collapsed into a single dimension. Further, if errors are assumed to be Gaussian, the probability of collision is the integral of the 1D probability density function, given by Eq. (4):

$$P = \frac{1}{2} \cdot \left[ \operatorname{erf}\left( \frac{S_0 + R_0}{\sqrt{2}} \right) - \operatorname{erf}\left( \frac{S_0 + R_0}{\sqrt{2}} \right) \right] \tag{4}$$

where the dimensionless well separation and radius are $$S_0 = \frac{S}{\sigma} \text{ and } R_0 = \frac{(r_o + r_r)}{\sigma},$$

S represents the separation between the wells and σ represents the relative positional uncertainty at one standard deviation, both measured along the line normal to the two wellpaths.

If the reference interval is not sufficiently long to solve in one dimension, a two-dimensional integration over the area shaded in FIG. 6 would be more appropriate. If the other simplifying conditions do not apply, the computation can be made using a three-dimensional integration in Mahalanobis space.

Figure 7:
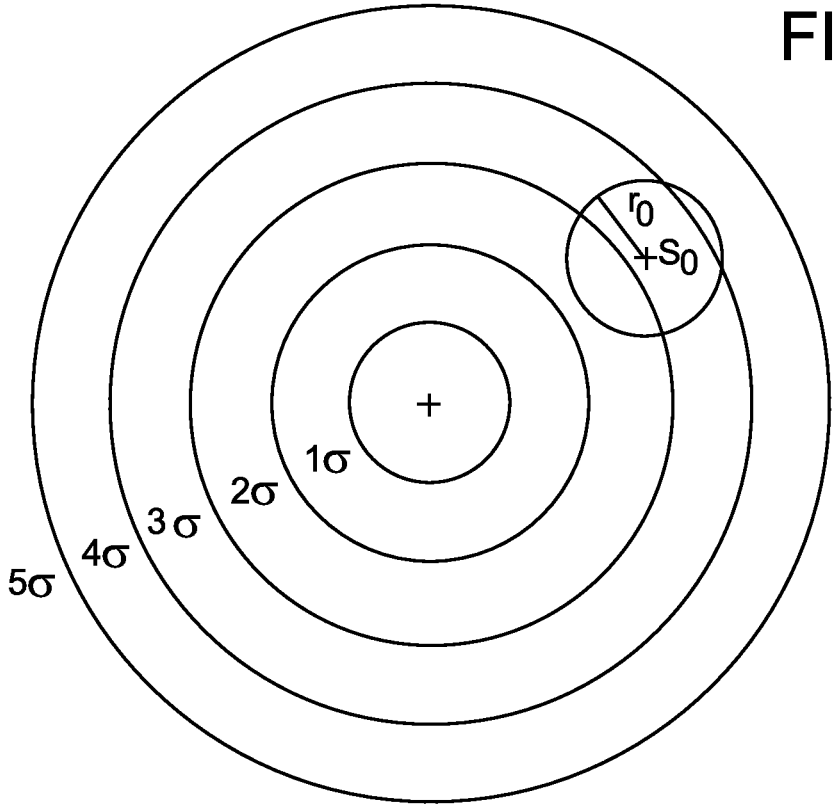
FIG. 7 illustrates aspects of a head-on approach to an existing parallel well, in a normal plane.
Figure 8:
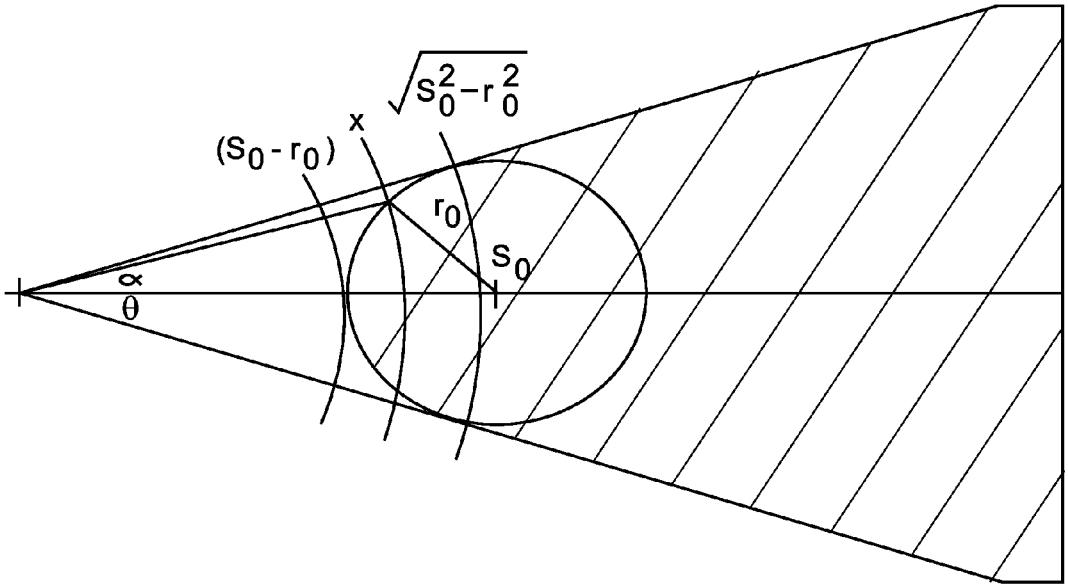
FIG. 8 depicts aspects of an existing well parallel to a well that is being drilled.

Straight parallel wells, head-on approach, constant uncertainty. Another special case is that of two straight wells which are approaching head-on. Although this is not a common situation, this might occur in some enhanced oil recovery operations. If this problem is simplified by assuming that the relative uncertainty is constant, the situation can be analyzed in real space, where the object well 22 appears as a circular tube. If the wellpaths are expected to overlap by more than about six (6) standard deviations, the along-hole uncertainty may be disregarded, and the problem can be analyzed in the plane normal to the wells, as shown in FIG. 7. The overall probability of collision is equal to the integral of the 2D probability density function over the projected area of the object well 22 in the normal plane. This is intuitively the correct result, since the integral of the 2D probability density function gives the probability that the wellpaths are sufficiently aligned. In the normal case when the surveyed lateral separation exceeds the sum of the well radii (i.e. collision is not intended), the integral of the Gaussian probability density function is provided as Eq. (5):

$$P = \frac{1}{\pi} \cdot \int_{S_0 - R_0}^{S_0 + R_0} \left[ \cos^{-1}\left( \frac{S_0^2 - R_0^2 + x^2}{2 \cdot S_0 \cdot x} \right) \cdot x \cdot \exp\left( -\frac{x^2}{2} \right) \right] dx \tag{5}$$

where the arc cosine function represents the half-angle subtended by the object well 22 at Mahalanobis distance x (shown as a in FIG. 8).

Straight parallel wells, side by side, variable uncertainty. A third simple case is that of straight parallel wells, side by side, such as might occur with vertical wells near the surface. To find a useful solution in this case, it is essential for the relative uncertainty to change along the wellpaths. Survey errors cause the covariance matrix to grow, so a constant relative uncertainty would imply no survey errors. In which case, if the wells were surveyed as parallel and they were not in collision at the start of the interval of interest, then they would indeed be parallel and no collision could occur.

Further assume that survey errors are azimuthally symmetrical, such that in Mahalanobis space the object well appears as a circular tube. Since the object well 22 is straight over the interval of significant risk, it can be assumed to extend to infinity. Thus, the 3D representation can be collapsed into two dimensions normal to the wells, which now appears as a circle. As depth increases along the reference well 21 and the relative uncertainties increase, projection of the object well 22 appears to shrink while it moves closer to the origin, as illustrated in FIG. 8. This is because the diameter and separation remain unchanged in real space, but the unit of measure (the standard deviation, or positional uncertainty) is becoming larger. If all survey errors are systematic, the uncertainty will be directly proportional to depth. Eventually, by taking a sufficiently long interval along the reference well, the area mapped by the object well approximates a sector of a circle with opening angle $2 \cdot \sin^{-1}[(r_r + r_o)/S]$, where $r_r$ and $r_o$ are the radii of the reference and object wells, and S is the nominal centerline separation. This angle is represented by $(2 \cdot \theta)$ in FIG. 8. The associated probability for wells of infinite length is simply the fraction of the circle occupied by that sector, as provided in Eq. (6):

$$P_\infty = \frac{1}{\pi} \cdot \sin^{-1}\left( \frac{r_r + r_o}{S} \right) \tag{6}$$

This solution may be surprising, because it is independent of survey accuracy. However, it is intuitively reasonable, because it is assumed that all survey errors are systematic. Therefore all possible wellpaths are straight lines, although they may not exactly coincide with the surveyed direction vector. Those wellpaths whose azimuths are heading toward the sector occupied by the object well will therefore eventually collide with it. The probability that a wellpath's azimuth is heading in that direction is simply the fraction of a circle occupied by the sum of the well diameters at the nominal separation distance, which is given by Equation (6).

Practical problems involving parallel wells will impose a maximum depth on the reference interval, resulting in a collision probability which does depend on survey uncertainty. This probability can be obtained by integrating the probability density function over the shaded area in FIG. 8, which includes the sector outward from its points of tangency with the circle corresponding to the maximum depth, and the portion of the circle inside these points. Applying this method to nominally parallel wells with a systematic Gaussian misalignment error μ in each well, the probability of a collision occurring between the surface and depth L is given by Eq. (7):

$$P = \frac{1}{\pi} \cdot \sin^{-1}\left( \frac{R_0}{S_0} \right) \cdot \exp\left[ -\frac{(S_0^2 - R_0^2)}{2} \right] + \frac{1}{\pi} \cdot \int_{S_0 - R_0}^{\sqrt{S_0^2 - R_0^2}} \left[ \cos^{-1}\left( \frac{S_0^2 - R_0^2 + x^2}{2 \cdot S_0 \cdot x} \right) \cdot x \cdot \exp\left( -\frac{x^2}{2} \right) \right] dx \tag{7}$$

where $S_0$ and $R_0$ are defined as for Equation (4), the arc sine and arc cosine functions represent the angles shown in FIG. 8 as θ and α respectively, and the relative uncertainty at the maximum depth L is given by $\sigma = \sqrt{2} \cdot L \cdot \tan \mu$.

It is noted that Eq. (7) is also applicable where random (as opposed to systematic) misalignment errors dominate. That is, Eq. (7) may be applied to random error by defining the uncertainty as $\sigma = \sqrt{(2 \cdot L \cdot D)} \cdot \tan \mu$, (at least, in this case) where D is the average distance between survey stations.

The probability of a collision occurring within an interval bounded by depths $L_1$ and $L_2$ is the difference between the probability of collision from the surface to $L_1$ and the probability of collision from the surface to $L_2$.

A troubling result of numerical estimates is that the computed collision probability can often be reduced by making survey accuracy sufficiently poor. This is known in the aerospace field. To give an example using Eq. (4); suppose that two wells are to cross with a surveyed separation of 20 m, and the sum of their radii is 0.3 m. If the standard deviation of their relative uncertainty is 10 m, the probability of collision is computed as 3.2E-3, for a standard deviation of 20 m the probability increases to 7.3E-3, but for a standard deviation of 50 m the estimated probability drops back to 4.4E-3. This phenomenon has been termed "probability dilution." This suggests that estimates which fall in the dilution region, where the estimated probability of collision decreases with increasing uncertainty, cannot be used with any confidence. Such estimates indicate that the survey quality is insufficient to permit a meaningful estimate of collision probability. A possible work-around in such cases is to set the uncertainty to that which produces the maximum probability of collision.

Conclusions. Various conclusions may be reached in the application of this method. Some of these conclusions are: 1. The probability of collision between an interval along a reference well and an existing object well can be computed in the general case as the integral of a three dimensional probability density function corresponding to an error distribution; 2. The volume of integration represents the space mapped out by the relative position of the object well with respect to an origin point which progresses along the interval of interest in the reference well; 3. The three dimensions bounding the volume of integration are directly related to the reversed locus of the interval of interest along the reference well, the locus of the object well path in the region of significant risk (out to about six (6) standard deviations), and the sum of the well diameters in a direction normal to the other two; 4. To account for variations in relative uncertainty along the intervals, the integration may be performed in Mahalanobis space. The transformation matrix between real space and Mahalanobis space is derived from the covariance matrix describing relative uncertainty between points in the two wells; 5. Numerical integration can be performed by breaking the volume of interest into elements, and summing the probability density function values corresponding to the centroids of those elements weighted by element volume; 6. If the object well is straight within the region of significant risk, the integration can be performed in two dimensional space normal to the object well; 7. A concise algebraic expression has been developed describing the probability of collision between two shallow straight parallel wells with systematic or random Gaussian misalignment errors; and, 8. All numerical estimates of collision probability are extremely sensitive to the nature of the error distribution and to the assumed error magnitudes, and they fail to account for unmodelled gross errors. These limitations must be understood by the end user.

Accordingly, key points of the teachings herein include: the probability of collision between an interval along a reference well and an existing object well may be computed in the general case as the integral of a three dimensional probability density function corresponding to an error distribution. In a particular embodiment, a Gaussian error distribution may be assumed. The volume of integration represents the space mapped out by the representation of the relative position of the object well with respect to an origin point which progresses along the interval of interest in the reference well. The three dimensions bounding the volume of integration are directly related to the locus of the interval of interest along the reference well, the locus of the object well path in the region of significant risk (five (5) or six (6) standard deviations), and the sum of the well diameters in a direction normal to the other two. To account for variations in relative uncertainty along the intervals, the integration can be performed in Mahalanobis space. Transformation to Mahalanobis space can be accomplished by a transformation matrix T, which can be found by $T=C^{-1/2}$, where C represents the position covariance matrix describing relative uncertainty between an origin point in the reference well and a point of interest in the object well. Integration can be performed by breaking the volume of interest into volume elements, and summing the probability density function values corresponding to the centroids of those volume elements, weighted by volume of each volume element. If the object well is straight within the region of significant risk, the integration can be performed in two dimensional space normal to the object well.

For convenience of referencing, the following nomenclature is generally applied herein where the following variables are taken to represent, respectively:

C Position covariance matrix describing relative positional uncertainty

D average distance between survey stations (m)

E Diagonal scaling matrix containing the eigenvalues of C k Mahalanobis distance, number of standard deviations L Maximum depth, shallow parallel wells, in meters (m)

P Probability of collision, fraction $R_0$ Dimensionless sum of well radii in Mahalanobis space, standard deviations r Relative position vector $r_o$ Radius of object well, m $r_r$ Radius of reference well, m S Separation between points in reference well and object well, m $S_0$ Dimensionless separation in Mahalanobis space, standard deviations T Transformation matrix between real space and Mahalanobis space V Rotation matrix whose columns are the eigenvectors of C σ Relative uncertainty along the line of interest at one standard deviation, m In support of the teachings herein, various analysis components may be used, including digital and/or an analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for drilling a well, the method comprising:

identifying another well proximate to the well being drilled;

collecting spatial information for at least a portion of the another well and the well being drilled, and representing one of the well being drilled and the another well as a line corresponding to a center line of the well being drilled or the another well;

representing the other of the well being drilled and the another well as an object having a radius based on a radius of the another well and a radius of the well being drilled;

estimating a trajectory for at least a portion of the well being drilled and the another well;

estimating an uncertainty in spatial information for each trajectory;

estimating a probability of a collision between the center line and the object during the drilling of the well by integrating a probability density function using the uncertainties and the trajectories; and performing the drilling in a manner that limits the probability of collision.

2. The method as in claim 1, further comprising summing the radii, and assigning the summed value as the radius of the object.

3. The method as in claim 2, further comprising reducing the radius of the wellbore of the unassigned well to zero.

4. The method as in claim 1, wherein the probability density function comprises a Gaussian distribution function.

5. The method as in claim 1, wherein the spatial information is expressed in at least one of a Mahalanobis space and a Cartesian coordinate system.

6. The method as in claim 1, wherein a result of the integrating represents a the probability of collision mapped out by the representation of the relative position of the object well with respect to an origin point which progresses along an interval of interest in the reference well.

7. The method as in claim 1, wherein dimensions bounding a volume of the integrating are related to at least one of: a locus of an interval of interest along at least one of the wells, a reversed path along the wellbore of at least one of the wells, and a sum of wellbore diameters for each of the wells.

8. The method as in claim 7, wherein the locus of the interval of interest is in a region of significant risk.

9. The method as in claim 1, wherein the integrating is performed using a Mahalanobis space.

10. The method as in claim 1, further comprising a transformation to a Mahalanobis space.

11. The method as in claim 1, wherein integration can be performed by breaking the volume of interest into volume elements, and summing the probability density function values corresponding to the centroids of those volume elements, weighted by volume of each volume element.

12. The method as in claim 1, wherein if one of the wells is straight within a region of significant risk, the integrating is performed for a two dimensional space normal to the other well.

13. The method as in claim 1, wherein integrating comprises numerically integrating.

14. A system for drilling a well, the system comprising:

a drilling apparatus for drilling the well, the apparatus adapted for receiving directional information from a processor and adjusting drilling according to the directional information;

the processor equipped for implementing instructions for avoiding collision during drilling of a well by performing a method comprising: identifying another well proximate to the well being drilled; collecting spatial information for at least a portion of the another well and the well being drilled, and representing one of the well being drilled and the another well as a line corresponding to a center line of the well being drilled or the another well; representing the other of the well being drilled and the another well as an object having a radius based on a radius of the another well and a radius of the well being drilled; estimating a trajectory for at least a portion of the well being drilled and the another well; estimating an uncertainty in spatial information for each trajectory;

estimating a probability of a collision between the center line and the object during the drilling of the well by integrating a probability density function using the uncertainties and the trajectories; and performing the drilling in a manner that limits the probability of collision.

15. A method for estimating a probability of collision, P, between near-parallel wells, the method comprising:

collecting spatial information by a survey tool for a well being drilled and for a planned drilling path of the well being drilled;

collecting spatial information by a survey tool for at least a portion of another well that is at least near-parallel to the well being drilled;

estimating separation information, $S_0$, and radius information, $R_0$, for a given depth, L based on the spatial information;

inputting at least the separation information and the radius information to a processor configured to estimate a probability, P, of collision between the object well and the planned well at the depth L; and estimating the probability by solving a relationship via the processor, the relationship comprising:

$$P = \frac{1}{\pi}\cdot\sin^{-1}\left(\frac{R_0}{S_0}\right)\cdot\exp\left[-\frac{(S_0^2-R_0^2)}{2}\right] + \frac{1}{\pi}\cdot\int_{S_0-R_0}^{\sqrt{S_0^2-R_0^2}}\left[\cos^{-1}\left(\frac{S_0^2-R_0^2+x^2}{2\cdot S_0\cdot x}\right)\cdot x\cdot\exp\left(-\frac{x^2}{2}\right)\right]dx;$$

where:

x represents a distance.

16. The method as in claim 15, wherein the estimating comprises:

solving the relationship at a first depth, $L_1$, and a second depth, $L_2$; and determining a difference between a result for the first depth, $L_1$, and a result for the second depth, $L_2$.

17. The method as in claim 15, wherein separation information, $S_0$, comprises a dimensionless separation between the wells.

18. The method as in claim 15, wherein radius information, $R_0$, comprises a dimensionless sum of well radii.

19. A method for drilling a well, the method comprising:

identifying another well proximate to the well being drilled;

collecting spatial information for at least a portion of the another well and the well being drilled, and representing the well being drilled or the another well as a line corresponding to a center line of the well being drilled or the another well;

estimating a trajectory for at least a portion of the well being drilled and the another well;

estimating an uncertainty in spatial information for each trajectory;

estimating a probability of a collision with the another well during the drilling of the well by integrating a probability density function using the uncertainties and the trajectories, the integration performed by breaking a volume of interest into volume elements, and summing the probability density function values corresponding to the centroids of those volume elements, weighted by volume of each volume element; and performing the drilling in a manner that limits the probability of collision.

* * * * *